United States Patent [19]

Weber et al.

[11] 4,355,824

[45] Oct. 26, 1982

[54] RECORD INDEXING SYSTEM

[76] Inventors: Joseph Weber; Maria L. Weber, both of 1105 Massachusetts Ave., Cambridge, Mass. 02139

[21] Appl. No.: 170,619

[22] Filed: Jul. 21, 1980

[51] Int. Cl.[3] ..... B42F 21/00

[52] U.S. Cl. ..... 283/21; 283/40; 283/42; 283/63 R

[58] Field of Search ..... 283/29, 36, 37, 38, 283/39, 41, 43, 48 R, 48 A, 42, 63, 18, 21, 40; 40/110, 340

[56] References Cited

U.S. PATENT DOCUMENTS

| | | | |
|---|---|---|---|
| 2,081,202 | 5/1937 | Hoyt | 283/42 X |
| 2,142,460 | 1/1939 | Schulz | 283/36 X |
| 3,290,059 | 12/1966 | Newman | 283/18 X |
| 3,680,229 | 8/1972 | Serrie | 283/63 X |
| 3,740,081 | 6/1973 | Whipperman | 283/21 X |
| 4,175,777 | 11/1979 | Horn | 283/42 |

FOREIGN PATENT DOCUMENTS

| | | | |
|---|---|---|---|
| 1217408 | 5/1960 | France | 283/38 |

*Primary Examiner*—Paul A. Bell
*Assistant Examiner*—John S. Brown
*Attorney, Agent, or Firm*—Kenway & Jenney

[57] ABSTRACT

The record indexing system includes a substrate sheet with a plurality of removable labels adhered on one surface of that sheet. The labels are substantially uniform in size and each extends along an associated longitudinal axis. Each label includes three zones on its top surface. The first zone extends from one end of the label along its longitudinal axis, the second zone extends from the other end of the label along that axis and the third zone separates the first and second zones and has a predetermined length in the direction of the axis. The first and second zones are characterized by one optical absorption spectrum and the third zone is characterized by another optical absorption spectrum. The separator zones for the labels are offset from one end of the labels by a different distance for each label.

3 Claims, 4 Drawing Figures

RECORD INDEXING SYSTEM

BACKGROUND OF THE INVENTION

This invention relates to indexing systems, and more particularly to indexing systems for phonograph record albums.

Phonograph record albums are typically sold within album covers that form relatively flat, thin, rectangular packages. For conventional $33\frac{1}{3}$ r.p.m. records, the album covers are typically $12\frac{3}{8}$ by $12\frac{3}{8}$ inches and are $\frac{1}{8}$ inches thick. With this configuration, it has become common practice for consumers to store their record albums in a book-like fashion on a shelf, with the relatively thin album ends facing outward. In keeping with this common practice, the record album manufacturers have generally put album identification information on the relatively thin end portion of the album which is exposed. However, when the albums are on a shelf, with these edges being visible, the relatively small thickness and variation in edge printing used by various manufacturers make it extremely difficult for a user to readily identify or locate a particular album from his collection. Conventional record filing systems have used address number tags for affixation to the various records, together with an index file type arrangement in which the various records are inserted, with each numbered record in its corresponding slot. However, when the records are in their respective slots, such numbering tags are relatively difficult to use. Furthermore, an index file portion of the system requires a separate element for permanent storage by the user.

Accordingly, it is an object of the present invention to provide a color-based indexing system.

SUMMARY OF THE INVENTION

Briefly, according to the present invention, a record indexing system is provided by a substrate sheet having a plurality of substantially uniform sized, removable labels adhered on one surface. Each label extends along an associated longitudinal axis and includes three zones on its top surface. The first zone extends from one end of the label along its longitudinal axis, the second zone extends from the other end of the label along its axis, and the third zone has a predetermined length, D, along the axis and separates the first and second zones. The first and second zones are characterized by a first optical absorption spectrum and the third zone is characterized by a second optical absorption spectrum. The third, or separation, zones of the labels are offset from one end of the labels by a different distance for each of the labels.

In use, each of the labels may be applied to one of the edges of a record album to be stored in the conventional upright position on a shelf. The labels are each applied to the album covers at a uniform distance from the top of the album covers. It will be understood that the labels each have a pressure sensitive adhesive on their backside which permits the labels to be readily removed from the substrate sheet and then transferred to the appropriate position on a record album cover. In this manner, with the albums in place on the shelf with the labeled edges exposed, the albums may be arranged so that the separation zones form a decreasing staircase which is readily visible to a user.

With this configuration, the labels may be set up with different colors, i.e. optical absorption spectra, for different types of music. For example, possible album categories might be rock, jazz, classical, show music, country and western. With a different color assigned to each category, a separate set of labels may be assigned for each of those categories. The ordering of the albums within the set of any given category may be easily discernible to a user by means of identifying the relative location in the step sequence of the separation zones for the respective labels. For example, in a collection of ten records where the albums are arranged with labels having a ten step succession of separation zones visible to the user, the removal of a single record generates a gap in the step sequence. When returning the album to the stored collection, the user may easily identify the location for that particular album by observing the gap in the step sequence. In conjunction with the use of these labels, the user may also maintain an artist and title index for the records corresponding to the position within the succession.

In alternate forms, the various labels may also include one or more fourth type zones centrally located within the second zone, with this fourth type zone having an optical absorption spectrum different from that of the second zone. The boundaries of this fourth zone may correspond to the boundaries of alphanumeric characteristics. With this configuration, the fourth zone may be in the form of a contrasting number or letter which further indicates the sequential position of the album to the user.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
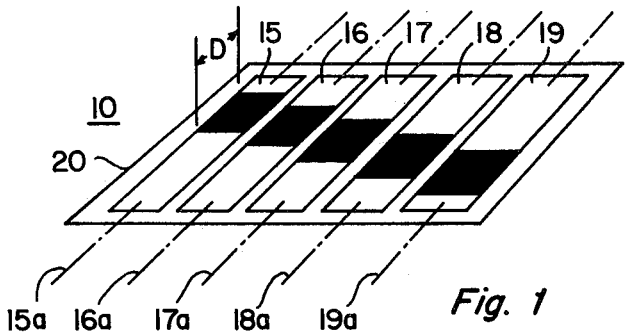
FIG. 1 shows an exemplary embodiment of the present invention.

FIG. 1 shows a record indexing system 10 in accordance with the present invention. The system 10 includes five substantially uniform size labels 15–19 on the upper surface of a substrate sheet 20. Each of labels 15–19 extends along its own associated one of longitudinal axes 15*a*–19*a*. In this embodiment, the labels 15–19 are conventional pressure sensitive labels which are removably adhered to the upper surface of the substrate sheet 20.

Each of labels 15–19 includes three zones: a first zone extending from the proximal (as shown in FIG. 1) end of the labels along the respective longitudinal axis for the labels. The second zone extends from the distal end of the labels along the associated axis for the respective labels. The first and second zones of the embodiment of FIG. 1 are indicated without shading. A third zone for each label is indicated by a solid black portion of the label. Each of these third zones separates the first and second zones for the respective labels, and has a predetermined length D along the associated axis for the label.

The first and second zones are characterized by a first optical absorption spectrum, so that they appear as a first color to a user. For example, this absorption spectrum may permit the user to view those zones of the labels as white. The third, or separation, zone is characterized by a second optical absorption spectrum which causes a user to view that zone as a color different from that associated with the first two zones. For example, the separation zone for the labels may appear to the user as red. Alternatively, the separation zone may be white and the first and second zones may be red, or some other contrasting color.

Each of the separation zones of the labels 15–19 is offset from the proximal end of the labels by a different distance. With this configuration, as viewed in position on the substrate 20 in FIG. 1, the labels provide a stepped succession of separation zones.

Figure 2:
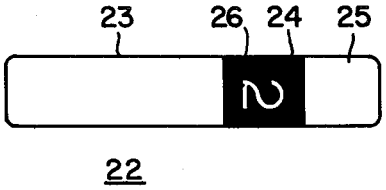
FIG. 2 shows an alternative form label for the embodiment of FIG. 1.

FIG. 2 illustrates a single label 22 in a somewhat different embodiment. Label 22 includes a first zone 23, second zone 24 and third zone 25 which are similar to the corresponding first, second, and third zones of labels 15–19. Label 22 also includes a fourth zone 26 which is centrally located within the third, or separation, zone 25. The fourth zone 26 has a boundary in the shape of the numeral "two" with the interior region of that numeral having an optical absorption spectrum which is different from that of the separation zone 25. As shown in FIG. 2, the zones 23, 25 and 26 have no shading, while the separation zone 25 is shown as black. In alternate embodiments, different optical absorption spectra, i.e. colors, may be utilized. It will be understood that in an embodiment of the invention such as that shown in FIG. 2, the fourth zones may have different alphanumeric characteristics for each of the labels.

Figure 3:
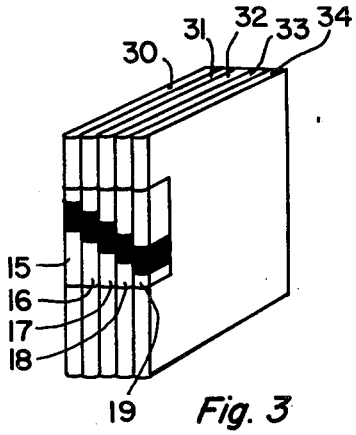
FIG. 3 shows the embodiment of FIG. 1 as used for an exemplary record collection.

By way of example, FIG. 3 shows five record album covers 30–34 which are aligned in an upright position (as for storage). As an example of the use of the labels 15–19 of FIG. 1, the album covers 30–34 are shown with one of the labels 15–19 applied to each album cover, where each label is the same distance from either the upper or lower edges of the album covers. With this configuration, the separation zones for each of the labels may be readily seen to form a staircase (or stepped) pattern when viewed by the user from the edge of the albums.

The following Table shows the dimensions for the location of the separation zone for the labels 15–19 of the present exemplary embodiment having 1.0×4.0 inch labels.

TABLE

| Label No. | $D_1$ | $D_2$ |
|---|---|---|
| 15 | 0.5 | 2.5 |
| 16 | 1.0 | 2.0 |
| 17 | 1.5 | 1.5 |
| 18 | 2.0 | 1.0 |
| 19 | 2.5 | 0.5 |

In the Table, the column $D_1$ corresponds to the distance (in inches) from the distal end of each label to the closest portion of the separation zone on that label. The column $D_2$ corresponds to the distance (in inches) from the proximal end of each label to the closest portion of the separation zone on that label. In this configuration, the separation zone of each label has a dimension D equal to 1.0 inch along the longitudinal axis of the label. When the labels 15–19 are applied to album covers as shown in FIG. 3, the stepped configuration has 0.5 inch steps.

With the present invention, the indexed arrangement formed by the various categories of albums and color labels, permits a user to logically index and store categories of records, while maintaining flexibility to accommodate a large number of such categories. Records may be easily located by first finding the color appropriate to that type of album and then finding the corresponding position of the separation zone within the succession of albums for that color. This latter step may be performed in conjunction with a written index. The records may be easily re-filed in their appropriate positions by making use of the readily discernible gap, or break, in the sequence of steps corresponding to the point at which the record album was removed.

Further, with this configuration, new records may be readily added to the index system by merely attaching a new label to the new record at an appropriate place on the album to continue the step sequence. According to the invention, in indexing systems for a large number of records, the step sequence may be repeated at various spatial increments down the line of records, particularly where the separation zone includes alphanumeric characters (such as shown in FIG. 2).

Furthermore, for relatively large population categories and relatively short (such as four inch length) labels, the step sequence may be continued without the need for indexing characters in the separation zone, for example, by applying the labels 15–19 to the upper portion of the edges of the first five record albums in the category, and then applying a corresponding set of labels to a lower portion of the edges of the next five record albums in the category. As a result, the separation zones for these ten record albums form a ten step sequence. This may be continued on to yet a third set of labels in a particularly large category.

In alternate forms of the invention, the first and second zones may be connected at the lateral edges of the label, i.e. so that the separation zone is in effect centrally located within the composite formed by the first and second zones. In keeping with the invention, it may be considered that the central portion along the longitudinal axis of the respective labels corresponds to the first and second zones which are still separated by the separation zone. In effect, with this configuration, it would be considered that two lateral zones extend along the lateral surfaces of the labels, with the lateral zones being characterized by an optical absorption spectrum corresponding to that for the first and second zones.

Figure 4:
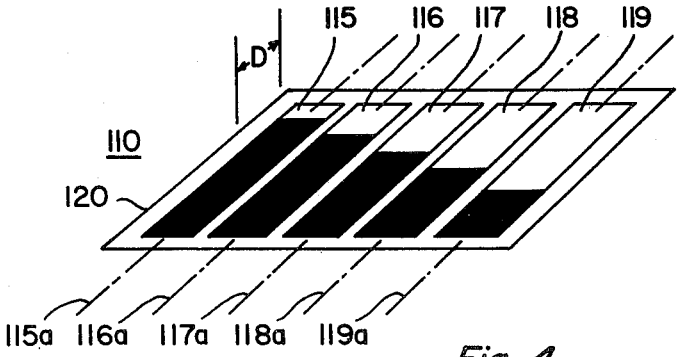
FIG. 4 shows another embodiment of the present invention.

FIG. 4 shows a record indexing system 110, which is another form of the present invention. System 110 is similar to the embodiment of FIG. 1 except that each label has only two zones rather than three. The system 110 includes five substantially uniform size labels 115–119 on the upper surface of a substrate sheet 120. Each of the labels 115–119 extends along its own associated one of longitudinal axes **115*a*–119*a*. In this embodiment, the labels 115–119 are conventional pressure sensitive labels which are removably adhered to the upper surface of the substrate sheet 120**.

Each of the labels 115–119 includes two zones: a first zone extending from the proximal (as shown in FIG. 1) end of the labels along the respective longitudinal axis for the labels. The second zone extends from the end of the first zone to the distal end of the labels along the associated axis for the respective labels. The first zone of each label of FIG. 4 is indicated without shading, and the second zone is indicated by a solid black portion of the label.

The first zone is characterized by a first optical absorption spectrum, so that it appears as a first color to a user. For example, this absorption spectrum may permit the user to view that zone of the labels as white. The second zone is characterized by a second optical absorption spectrum which causes a user to view that zone as a color different from that associated with the first zone. For example, the third zone for the labels may appear to the user as red.

The boundary between each of the zones of the labels 115–119 is offset from the proximal end of the labels by a different distance. With this configuration, as viewed in position on the substrate 120 in FIG. 4, the labels provide a stepped succession of the boundaries.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A record indexing system comprising a substrate sheet having a plurality of uniform size, removable labels adhered on one surface, each label extending along an associated longitudinal axis and including three zones on its top surface, wherein the first of said zones extends from one end of said label along said axis, the second of said zones extends from the other end of said label along said axis and the third of said zones has a predetermined length D along said axis, said first and second zones being characterized by a first optical absorption spectrum and said third zone being characterized by a second optical absorption spectrum, wherein the third zones of said labels are offset from said one end of said labels by a different distance for each of said labels, wherein the boundaries between said first and third zones and between said second and third zones are substantially perpendicular to said axes, and wherein the mid-point of each third zone along said axis is offset from the mid-point of at least one other third zone by a distance greater than zero and less than D along said axis.

2. A system according to claim 1 wherein said labels includes a fourth zone on said top surface, said fourth zone being centrally located within said third zone and being characterized by an optical absorption spectrum different from that of said second zone, wherein the boundaries of said fourth zones define a different alphanumeric character for each of said labels.

3. A record indexing system comprising a substrate sheet having a plurality of uniform size, removable labels adhered on one surface, each label extending along an associated longitudinal axis and including two zones on its top surface, wherein the first of said zones extends from one end of said label along said axis, the second of said zones extends from the end of said first zone to the other end of said label along said axis, said first zone being characterized by a first optical absorption spectrum and said second zone being characterized by a second optical absorption spectrum, wherein the boundary between said first and second zones of said labels are offset from said one end of said labels by a different distance for each of said labels, wherein the boundary between said first and second zone is substantially perpendicular to said axis, wherein said boundary of each label is offset from said boundary of at least one other label by a predetermined distance.

* * * * *